United States Patent [19]

Herst et al.

[11] Patent Number: 4,939,627

[45] Date of Patent: Jul. 3, 1990

[54] INDIRECT LUMINAIRE HAVING A SECONDARY SOURCE INDUCED LOW BRIGHTNESS LENS ELEMENT

[75] Inventors: Douglas J. Herst, Berkeley; Peter Y. Y. Ngai, Danville, both of Calif.

[73] Assignee: Peerless Lighting Corporation, Berkeley, Calif.

[21] Appl. No.: 407,721

[22] Filed: Sep. 14, 1989

Related U.S. Application Data

[63] Continuation of Ser. No. 260,287, Oct. 20, 1988, abandoned.

[51] Int. Cl.[5] ..... F21V 7/00

[52] U.S. Cl. ..... 362/299; 362/147; 362/223; 362/260; 362/328

[58] Field of Search ..... 362/147, 217, 219, 223, 362/224, 245, 246, 260, 328, 404, 408, 299, 300

[56] References Cited

U.S. PATENT DOCUMENTS

| | | | |
|---|---|---|---|
| 4,390,930 | 6/1983 | Herst et al. | 362/224 |
| 4,644,454 | 2/1987 | Herst et al. | 362/224 |
| 4,698,734 | 10/1987 | Ngai | 362/225 |

OTHER PUBLICATIONS

Lite Control Catalog, Low Ceiling Indirect Lighting, Lite Control Corporation, 1987.

*Primary Examiner*—Stephen F. Husar

*Attorney, Agent, or Firm*—Donald L. Beeson

[57] ABSTRACT

An indirect lighting system having a generally visible light transmissive element, such as a prismatic lens element or a diffuser strip, which modifies the direction of the light incident thereon from a secondary light source. The lighting system has a primary light source and structural means for positioning the primary light source proximate a reflective surface which reflects light back toward the light transmissive element and which thereby acts as a secondary source of light for illuminating this element. A light foil means is disposed between the primary light source and light transmissive element for substantially blocking direct transmission of light to the latter from the former. The light foil means, by keeping primary source light from directly striking the light transmissive element, forces the observable brightness in this element to be induced substantially entirely by the reflected light from the secondary source.

11 Claims, 5 Drawing Sheets

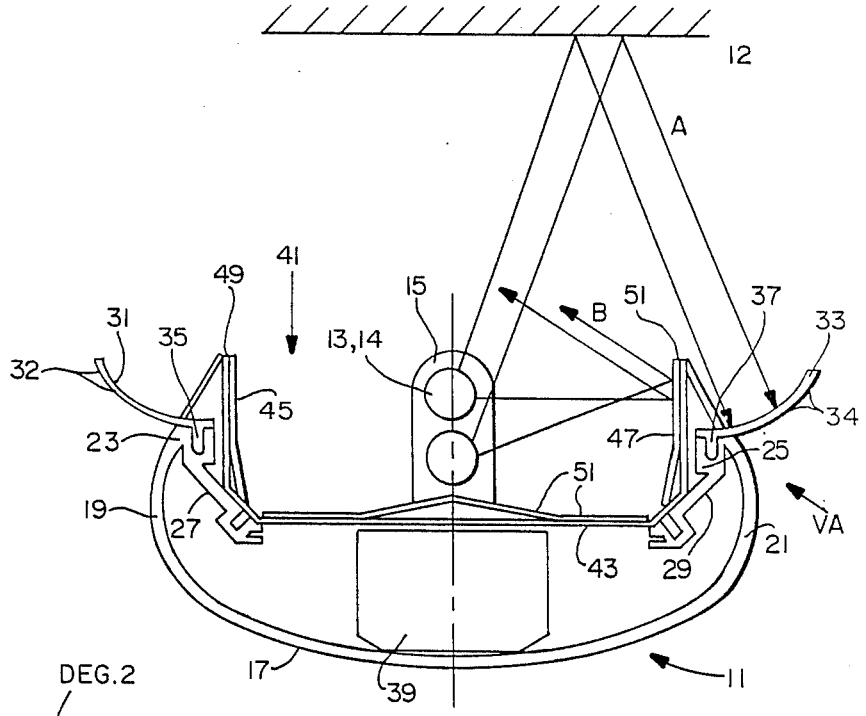
FIG.-4
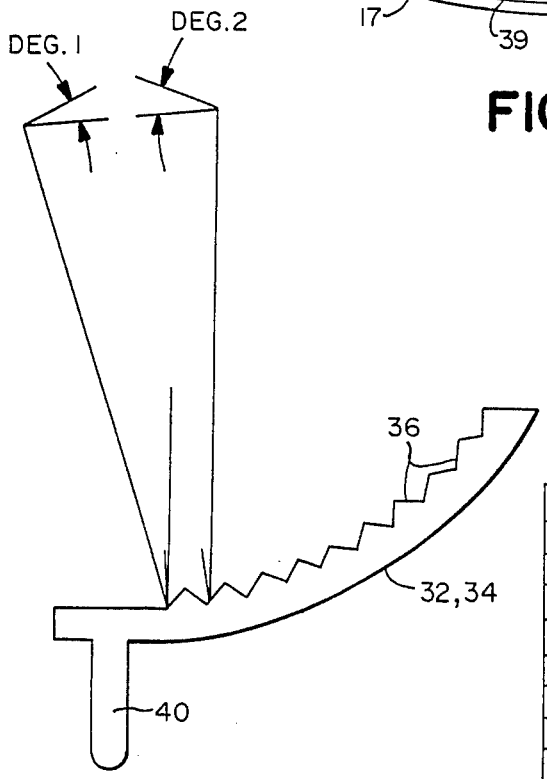
FIG.-5
| PRISM | DEG-1 | DEG-2 |
|---|---|---|
| 1 | 40 | 24 |
| 2 | 40 | 26 |
| 3 | 40 | 26 |
| 4 | 40 | 30 |
| 5 | 40 | 31 |
| 6 | 40 | 33 |
| 7 | 40 | 36 |
| 8 | 40 | 39 |
| 9 | 40 | 42 |
| 10 | 40 | — |
FIG.-5A

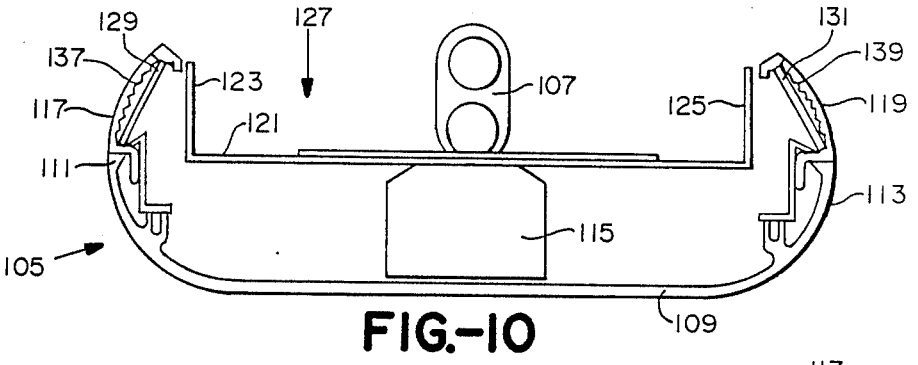
FIG.-10
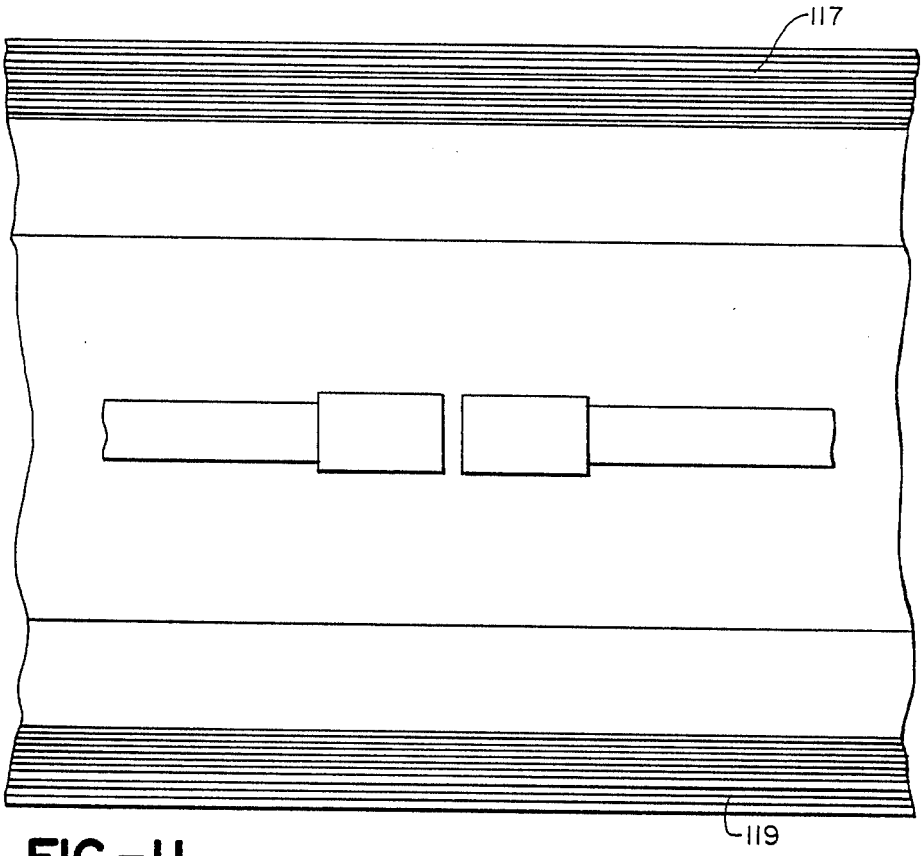
FIG.-11
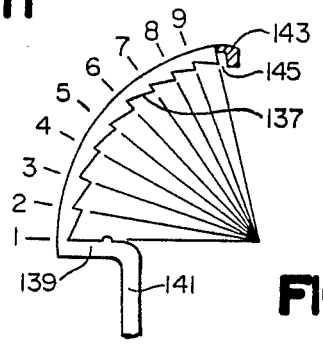
FIG.-12
| PRISM | DEG. |
|---|---|
| 1 | 54 |
| 2 | 56 |
| 3 | 58 |
| 4 | 60 |
| 5 | 62 |
| 6 | 65 |
| 7 | 67 |
| 8 | 69 |
| 9 | 70 |
FIG.-12A

INDIRECT LUMINAIRE HAVING A SECONDARY SOURCE INDUCED LOW BRIGHTNESS LENS ELEMENT

This is a continuation of Ser. No. 260,287, filed Oct. 20, 1988, now abandoned.

BACKGROUND OF THE INVENTION

The present invention relates to indirect lighting fixtures and system generally, and particularly to luminaires for indirect lighting which employ lens elements or other light transmissive media as a visible source of low brightness to persons in indirect lighting environments.

Indirect lighting, which is produced by reflecting light from a light source off a reflective surface such as a wall or ceiling, has long been criticized as producing a dull lighting environment, sometimes referred to as a cloudy day or funeral parlor effect. Nonetheless, lighting designers are increasingly considering indirect lighting systems for various applications because of the even illumination they provide and because they eliminate glare associated with direct lighting systems. Indirect lighting has become particularly advantageous in the open office environment where video display terminals (VDT's) are now prevalent and where uncomfortable glare on VDT screens often produced by direct lighting fixtures, such as the ubiquitous recessed ceiling fixtures (called troffers), can lead to VDT operator fatigue and, some now believe, long term health problems.

To overcome the perceived dull lighting environment produced by conventional indirect lighting, indirect fixtures have been devised with visible low brightness lens elements which give the observer of the fixture a perception or illusion of seeing the actual source of light. Such a fixture is described in U.S. Pat. No. 4,390,930 issued June 23, 1983, which discloses a linear extruded fixture for indirect lighting having lens strips running along the top of the fixture housing's opaque side walls. The lens extensions of the housing side walls have a prismatic surface formed to direct a small portion of the light received from the fixture's light source into normal viewing angles below the plane of the fixture. The resulting brightness of the visible lens surface is generally sufficient to give a perception of source brightness and as a result gives the psychologically more pleasing effect of being able to visually locate the light source, while avoiding discomfort associated with excessive brightness and glare producing contrast brightness.

Studies have shown a further psychological advantage to low brightness lens elements on indirect fixtures and particularly linear indirect fluorescent fixtures. It has been found that the low brightness lens elements below certain maximum brightness ranges will actually tend to increase a subject's perception of the overall light level in a space being illuminated by lensed indirect fixtures. Accordingly, lensed indirect fixtures will permit comfortable lighting at lower light levels resulting in lower energy consumption.

Despite its advantages, lensed indirect fluorescent lighting has heretofore suffered from the difficult problem of achieving uniform brightness in the visible fixture lenses. The principal problems are first the appearance of socket shadows on the surfaces of the lens elements adjacent the electrical socket holders for the fixture's fluorescent lamps, and secondly, uncontrollable brightness on particular prism surfaces at particular viewing angles. Socket shadows and localized areas of excessive brightness have become a particular problem with the advent of biax fluorescent lamps which are considerably smaller and have higher light output than standard sized fluorescent.

Excessive brightness in lensed indirect fixtures frequently occurs along the lens' very top edge. It can also appear within the body of the lens such as discussed in U.S. Pat. No. 4,698,734 issued Oct. 6, 1987, which addresses the problem of side angle lens brightness, that is, hot spots on the lens produced by prior prismatic lens designs at viewing angles other than a viewing angle that is perpendicular to the lens surface. The above patent discloses a solution to the side angle brightness problem using a lens design which to some degree sacrifices the lens' ability to spread the light overhead the fixture.

Still a further problem with lensed indirect lighting fixtures is the ability to control the overall lens brightness at normal viewing angles (roughly from near horizontal to 45 degrees below horizontal) at very low luminance levels. As above-mentioned, studies have found that a low brightness lens element on a lensed indirect fixture can increase the perceived light level in the indirectly lit environment. Generally, it is believed that lens brightness levels below approximately 400 footlamberts will provide a visually comfortable lens, however, ideally the lens brightness levels should be kept within lower brightness ranges of approximately 50–200 footlamberts. With existing lens indirect lighting fixtures, such low luminance levels are very difficult to achieve with uniformity over the lens surface.

The present invention overcomes the above-mentioned problems associated with lensed indirect lighting by providing an indirect lighting system having lens elements capable of being maintained at very low brightness levels and having nearly absolute uniformity of brightness over the entire observable lens surface. The present invention eliminates distracting socket shadows on the lens and produces a lens brightness level that tends to be self-adjusting with respect to the brightness levels on the overhead ceiling or upper wall surfaces adjacent to which the lighting fixtures of the system are suspended or mounted. That is, as the distance between the fixture and the reflective surface behind the fixture is increased, both the brightness of the background reflective surface and the fixture lenses decrease. The reverse is true if the fixture to surface separation is decreased.

SUMMARY OF THE INVENTION

Briefly, the present invention provides for an indirect lighting system having a generally visible light transmissive element, such as a prismatic lens element or a diffuser strip, which modifies the direction of the light incident thereon from a secondary light source. The lighting system has a primary light source and structural means for positioning the primary light source proximate a reflective surface which reflects light back toward the light transmissive element and which thereby acts as a secondary source of light for illuminating this element. A light foil means is disposed between the primary light source and light transmissive element for substantially blocking direct transmission of light to the latter from the former. The light foil means, by keeping primary source light from directly striking the light transmissive element, forces the observable brightness in this element to be induced substantially entirely by the reflected light from the secondary source.

Means are provided for causing at least a portion of the secondary source light incident on the transmissive element to be directed into normal viewing angles for persons observing the light transmissive element. As seen in the illustrated embodiments, such means include proper positioning of the light transmissive element and the light foil means relative to the primary and secondary light sources and can further include light refracting prisms on a lens media for focusing the distribution of light passing through the lens. In one aspect of the invention, it is contemplated that the light transmissive element will be positioned to receive or "catch" secondary source light on its interior surface and to transmit the secondary source light directly into the above-mentioned normal viewing angles. In this embodiment, the light foil means is positioned inwardly of the light transmissive element between this element and the primary light source. In another aspect of the invention, the light transmissive element is positioned to receive or "catch" secondary source light on its exterior surface. In this embodiment the light foil means includes a reflector means extending directly behind the interior surface of the light transmissive element so as to prevent any light, primary or secondary source light, from directly reaching the inside surface of the light transmissive element. Rather, in this embodiment, secondary source light passes through the exterior surface of, and is then reflected back out through, this element.

The light transmissive element of the invention will give a perception of source brightness by a virtue of the secondary source light passing through it and by virtue of the element's modification of the direction of the secondary source light. The element is not transparent to the observer. The light passing through the element appears to come from the element itself rather than being surface reflected light.

The invention's light transmissive element will preferably be an elongated strip of lens positioned to extend along the side walls of the opaque housing of a luminaire for indirect lighting. In accordance with the illustrated embodiments of the invention, this lens strip can be positioned at the top of the housing, as in the case of the luminaire suspended below an overhead ceiling, or along any top, bottom, or side perimeter of a luminaire housing for a wall mounted luminaire. In any case, the secondary source light comes from the ceiling or wall surfaces next to which the luminaire is mounted.

While the embodiments of the invention described and illustrated herein pertain to discrete linear fixture units which can be used individually or connected together in runs of fixtures, it will be appreciated that the invention is not limited to discrete lensed indirect fixtures, whether of a linear or non-linear geometry. For instance, an indirect lighting system in accordance with the invention might be achieved using cove lighting as the primary light source, and using suitably positioned lens elements and light foil means with the cove lighting.

It is therefore seen that a primary object of the present invention is to provide a improved lensed indirect lighting system and luminaire having an low brightness light transmissive element, such as a lens strip, for providing a perception of source brightness in the space which is indirectly illuminated by the luminaires of the system. It is a further object of the invention to provide such a lensed indirect lighting system and luminaire wherein each light transmissive element of the system and luminaire has very low uniform brightness over the entirety of its visible surface, and wherein lens shadows, such as socket shadows are eliminated. Other objects of the invention will become apparent from the following detailed description of the preferred embodiment.

DESCRIPTION OF THE DRAWINGS

FIG. 4 is a cross-sectional view thereof;

FIG. 5 is an end elevational view of a prismatic lens used on the luminaire of FIGS. 1–4;

FIG. 5A is a prism chart showing the prism angles for the lens of FIG. 5;

FIG. 10 is a cross-section view of an alternative embodiment of a lensed indirect luminaire in accordance with the invention wherein a reflector element is placed directly behind the luminaire's lens element for reflecting back secondary source light incident on the exterior surface of the element;

FIG. 11 is a partial top plan view thereof; and

FIG. 12 is a side elevational view of the prismatic lens element of the luminaire illustrated in FIGS. 10–11.

DETAILED DESCRIPTION OF THE ILLUSTRATED EMBODIMENT

Figure 1:
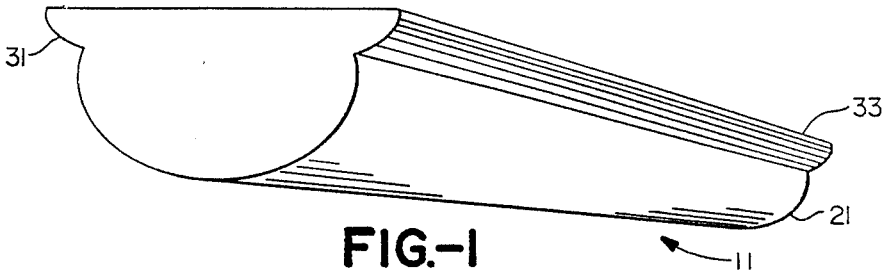
FIG. 1 is a perspective view of a linear lensed luminaire in accordance with the invention.
Figure 2:
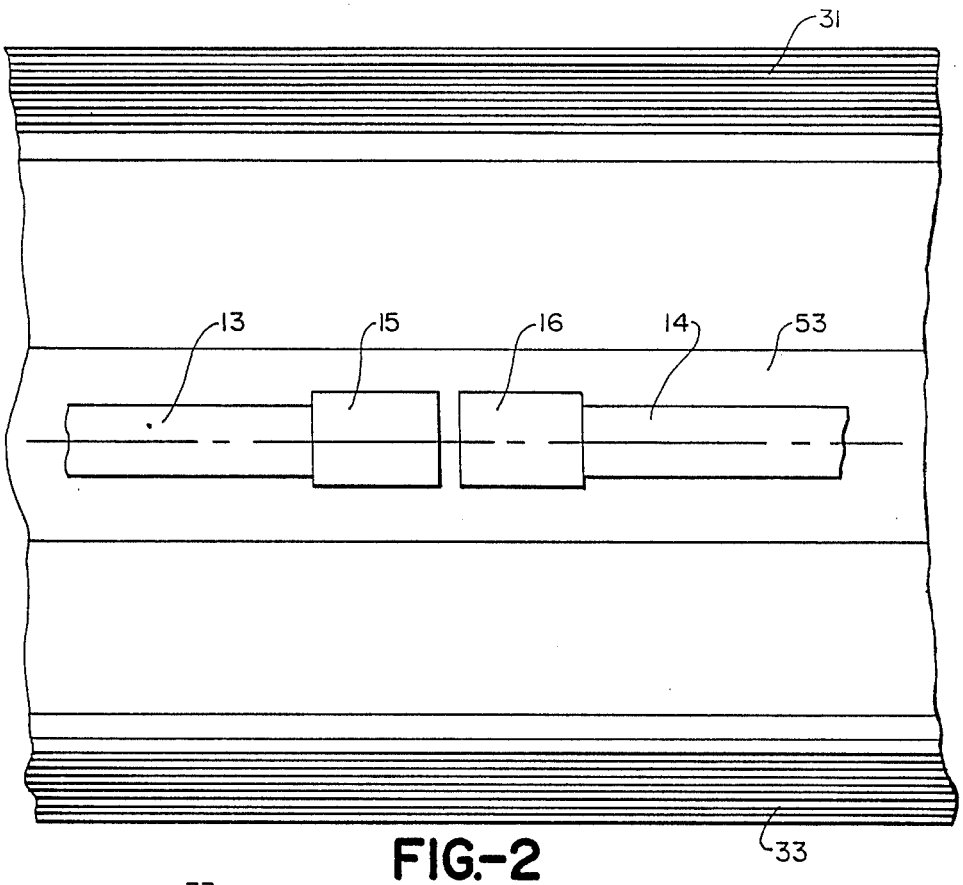
FIG. 2 is a partial top plan view thereof.
Figure 3:
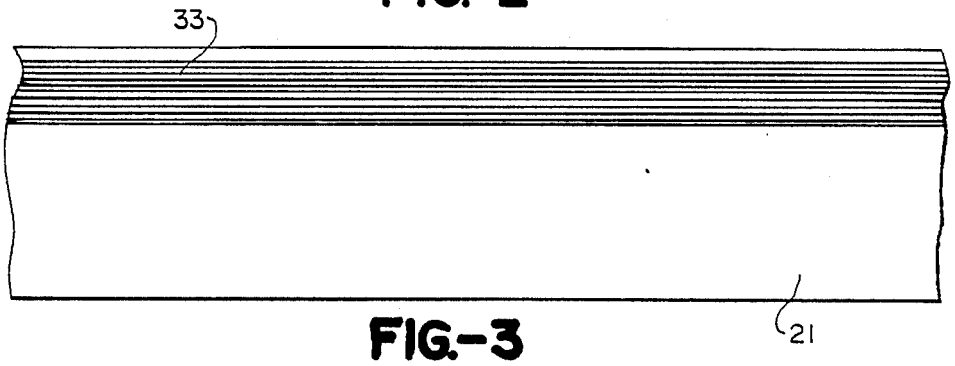
FIG. 3 is a partial side elevational view thereof.

Referring now to the drawings, and specifically to the embodiment of the invention illustrated in FIGS. 1–4, an indirect luminaire 11 has a primary light source in the form of biax lamps 13, 14 removably mounted in lamp sockets 15 spaced at regular intervals along the length of the luminaire. The lamp sockets are suitably mounted in an elongated opaque housing 17 which has opposite upwardly extending side walls 19, 21, on the top of which are formed lens mounting rims 23, 25 and inwardly extending reflector supports 26, 27. Elongated lens elements 31, 33 are mounted to the housing side walls by securing the base 35, 37 of the lenses to the support rims 23, 25. As best illustrated in FIG. 4, the lens elements extend laterally outwardly and upwardly in an arcuate shape away from the top of the housing so as to generally face the overhead ceiling surface 12. As hereinafter described, the overhead ceiling surface below which the luminaire 11 is positioned will act as a secondary source of light for the laterally extending lenses 31, 33 because of the ability of the surface to bounce or reflect light from the biax lamps 13 back toward the luminaire.

The luminaire housing 21 holds a ballast 29 and the necessary electrical wiring (not shown) for electrifying the lamp sockets 15, 16. A generally defined top opening 41 at the top of the housing permits light from the lamps 13, 14 to emerge from the luminaire in an overhead light distribution which illuminates the overhead ceiling surface 12 and any upper vertical wall surfaces (not shown) in the vicinity of the luminaire. Reflector means in the housing generally behind and to the side of the lamps 13, 14 consist of a bottom reflector plate 43, suitably a diffuse white reflector, and side reflector walls 45, 47. The side reflector walls, which are seen to extend substantially vertically upward from near the bottom of the bottom reflector plate 43 through the top opening of the luminaire to approximately the maximum height of the lamp sockets 15, 16, and which suitably can be Hammertone reflectors, are supported in their upright position by the side support bracket structures 49, 51. These reflector walls generally act to reflect light incident from lamps 13 laterally of the luminaire to achieve a widespread distribution of light overhead the luminaire. As will be discussed further below, the side reflector walls and supporting structures will also act as a light foil means between the lamps and lens elements for substantially blocking direct transmission of primary source light to the lens elements.

With reference to FIG. 4, it can be seen that laterally extending lens elements 31, 33 catch secondary light reflected from the overhead ceiling surface 12 as depicted by the light rays denoted by the letter "A." The side reflector walls 45, 47 permit these secondary light rays to reach the lenses, but defeat the ability of primary source light rays, represented by the letter "B," to do so. Therefore it can be seen that the brightness in the lens elements is induced substantially entirely by the secondary source of light from the ceiling. Because the ceiling generally provides a non-specular reflective surface, the diffuse nature of the light from the secondary source will evenly illuminate the lens elements over their entire length with the result that socket shadows and shadows created by other luminaire structures, such as source baffle elements, are eliminated. Also eliminated because of the diffuse nature of the secondary source light are localized bright areas on the lens at all viewing angles.

It is noted that the exterior surfaces 32, 34 of the lens elements 31, 33 are generally seen by persons in the vicinity of the luminaire at normal viewing angles which generally range from high viewing angle, which is approximately horizontal if the person is standing far away from the fixture, to a low viewing angle somewhat below horizontal for a person standing closer to, but within line of sight of the fixture. A typical viewing angle within this range is generally shown by the arrow denoted "VA" in FIG. 4. As earlier indicated, it is desirable that within normal viewing angles, the brightness of the exterior surfaces of the lens elements be maintained at very low levels, generally between 50 and 200 footlamberts. With the present invention, such lens brightness levels can be uniformly obtained over the entire lens surface by suitably spacing the luminaire 11 below the overhead ceiling surface 12. The spacing will depend on the lighting design, including the light output of the luminaire and the reflectivity of the overhead ceiling surface. Generally, it is believed that a fixture to ceiling distance of less than 18 inches is not desirable, in that, it will tend to produce hot spots on the overhead ceiling which in turn may induce excessive brightness in the luminaire's lens elements. As the fixture is moved away from the ceiling surface, the lens elements will diminish in brightness, with the maximum spacing being dictated by the observable brightness needed in the lens elements to achieve the desired perception of brightness in the lenses. It is contemplated that luminaires of the type generally illustrated in FIGS. 1–4 will be positioned below the ceiling by suspending the luminaire or luminaires from the ceiling, or mounting the luminaires from other structures such as opposing vertical wall surfaces or room partitions.

A particular lens element suitable for use in the FIGS. 1–4 luminaire is illustrated and described in FIGS. 5 and 5A. This lens element is an elongated lens element having a uniform cross-sectional shape preferably fabricated of an extruded acrylic plastic material. The visually active portion of the lens is defined by the interior prismatic surface 36 and the visible exterior surface 32, 34. This portion extends generally outward and upward in an arcuate shape from the lens base 35, 37 which has a mounting rib 40 projecting from the bottom thereof. The prismatic surface 36 on the interior of the lens is generally a non-directional light diffusing prismatic configuration having representative prism angles as shown in FIGS. 5A. It is understood, however, that the prismatic surface 36 of this lens can be modified as desired to be directional for increasing or decreasing the amount of light directed into particular viewing or non-viewing angles to the side of the luminaire.

In further reference to FIG. 4, it can be further noted that the directionality of the light emerging from the top opening 41 of the luminaire can be enhanced by the unique use of a kicker lens 53 laid over the top of the bottom reflector 43. This kicker lens can suitably be of a flat Frennell lens which will cause the light reflected from the bottom reflector to be concentrated in particular directions, such as concentrating the light off the reflector toward the vertical Hammertone reflector walls 45, 47 for enhancing the widespread light distribution of the luminaire.

Figure 6:
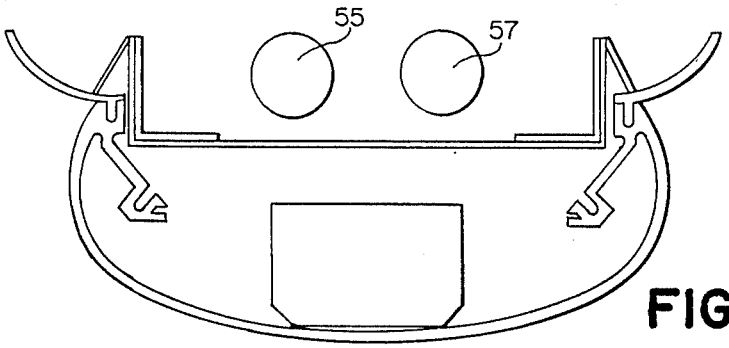
FIG. 6 is a cross-sectional view of the luminaire of FIGS. 1–3, showing a two lamp version thereof.

FIG. 6 illustrates an alternative embodiment of the luminaire shown in FIGS. 1–4 wherein the high intensity biax lamps 13, 14 of the FIGS. 1–4 luminaire are replaced by two lower intensity fluorescent lamps 55, 57, such as standard sized T8 or T12 lamps. It will be readily appreciated that the invention is in no way limited by particular lamp configuration, and that different types of lamps, including non-fluorescent lamps, and lamp configurations can be used in conjunction with the invention.

Figure 7:
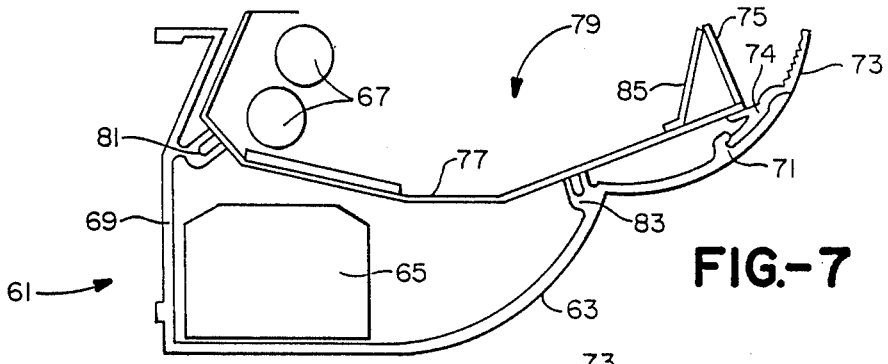
FIG. 7 is a cross-section view of a wall-mounted version of a lensed luminaire for indirect lighting in accordance with the invention.
Figure 7A:
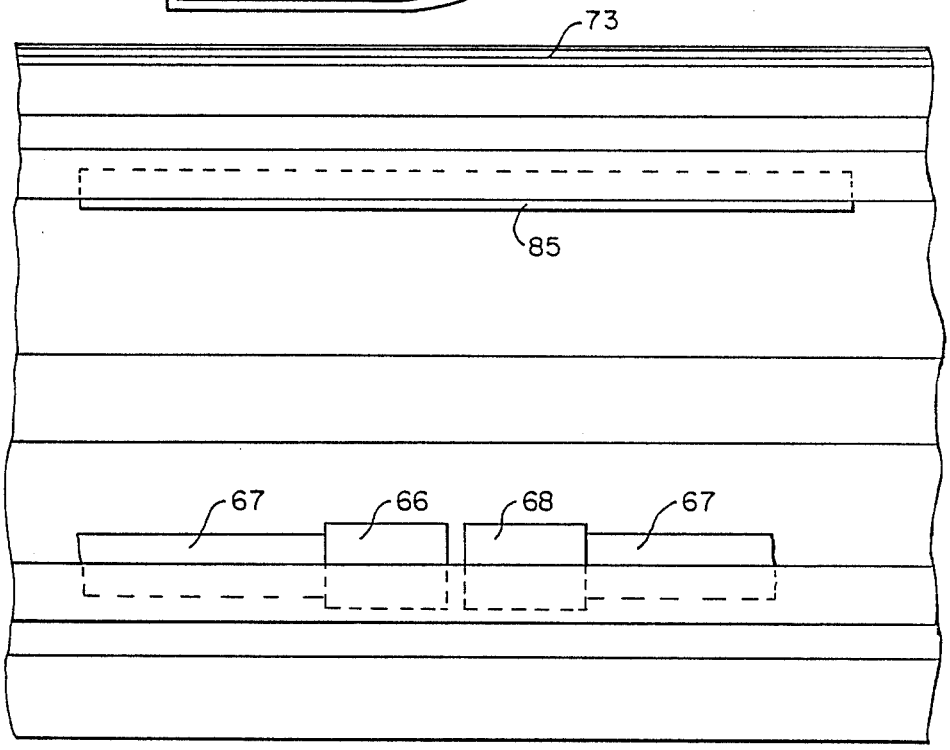
FIG. 7A is a partial top plan view thereof.

FIGS. 7–7A shows still another embodiment of the invention wherein the luminaire is an asymmetrical wall mounted luminaire generally denoted by the numeral 61, instead of a symmetrical luminaire as shown in FIGS. 1–4. In the FIG. 7 embodiment, the luminaire is comprised of an asymmetrical opaque housing 63, ballast 65 positioned at the back of the housing, and high intensity biax lamps 67 serving as the luminaire's primary light source. A housing back wall 69 extends upward behind the light source to serve as a mounting surface for mounting the luminaire by suitable bracket means against a vertical wall surface (not shown). The housing, which extends away from this back wall outward and then upward about the light source in a double convoluted shape, additionally provides an opaque side wall 71, the end of which receives, by means of a snap-in engagement, elongated lens element 73. It can be seen that the lens element 73 generally provides an extension of the shape of the housing side wall 71 up to approximately the height of the biax lamps.

A shaped reflector 77 for reflecting light up through the top opening 79 of the FIGS. 7–7A luminaire and which is mounted within the housing 63 on reflector mounts 81, 83 extends generally from behind the biax lamps forwardly to the base 74 of lens element 73. The extreme end 75 of the reflector is bent upward to provide a light foil means for the lens element 73, that is, a means for preventing the light from the biax lamp 67 from being directly received by the lens element. Additionally, a back reflector strip 85, positioned in opposition to the lamp sockets 66, 68, is secured inwardly of the extended end 75 of the reflector at an angle which increases the amount of light reflected back against the vertical wall surface against which the luminaire is mounted in areas adjacent the lamp sockets 66, 68. Back reflector strip 85 acts to illuminate dark areas on adjacent wall surfaces created by the presence of the lamp sockets.

It will be understood that light from the luminaire of FIGS. 7 and 7A will be directed through the luminaire's top opening 79 against upper wall and overhead ceiling surfaces (not shown) which will in turn send some light back toward the luminaire to illuminate the lens element 73 positioned behind the light foil 75. As described in connection with the FIGS. 1–4 embodiment of the invention, this will cause the brightness in this lens element to be induced substantially entirely by the secondary source light.

Figure 8:
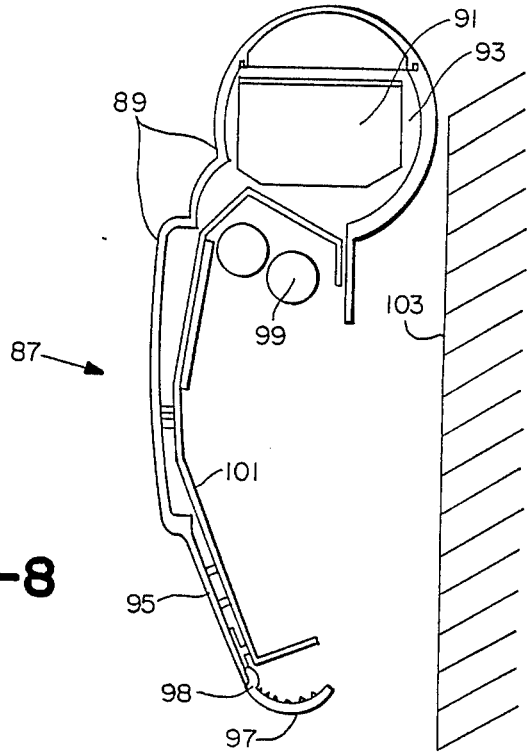
FIG. 8 is a cross-section view of another wall mounted version of a lensed indirect luminaire in accordance with the invention.
Figure 9:
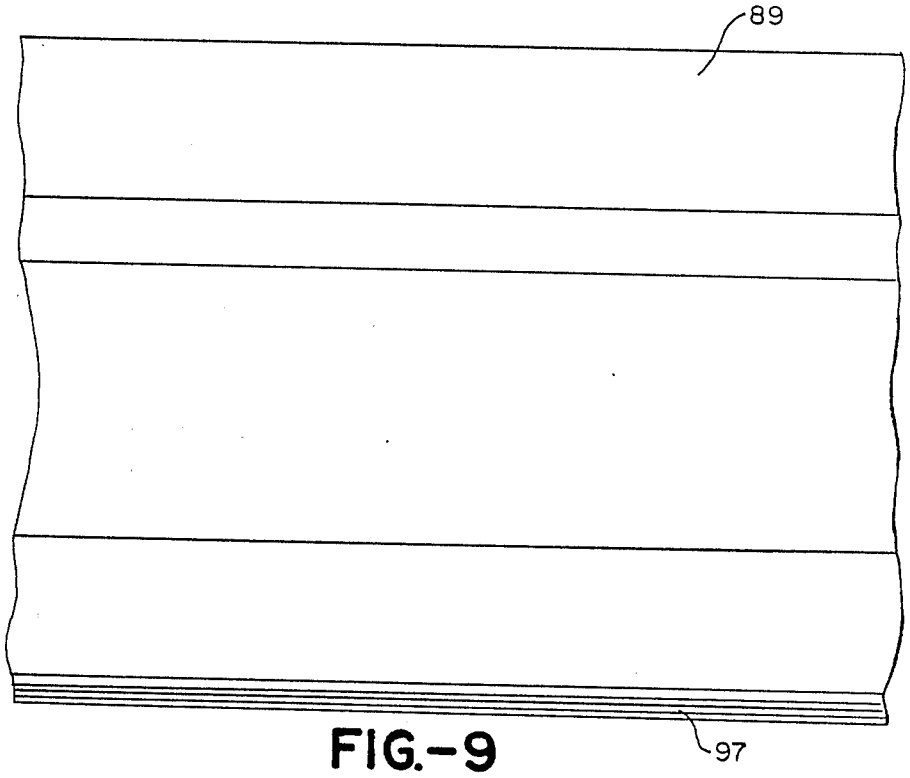
FIG. 9 is a partial side elevational view thereof.

FIGS. 8 and 9 illustrate another wall mounted version of the invention wherein the light transmissive media for receiving the secondary source light is provided at the bottom rather than the top of the luminaire. With reference to FIGS. 8 and 9, a wall mounted luminaire 87 has an elongated opaque housing 89 and a ballast 91 mounted in a top cavity 93 of the housing. The housing extends downwardly from the ballast to form a lower opaque side wall 95 to which an elongated lens element 97 is attached and of which the lens element forms a geometrically pleasing extension. The luminaire's primary light source consists of biax lamps 99 mounted proximate the top of the luminaire beneath the ballast 91. A shaped reflector 101 extends from behind the lamps 99 downward along the downward extension of the housing until it reaches the base 98 of the lens element. At this point, the extreme end of the reflector is bent inward and slightly upward to form a light foil means for the lens element 97, again to prevent primary source light from directly reaching the lens. It can be appreciated that the shaped reflector 101 directs some of the light from the primary light source of this embodiment of this luminaire against the vertical wall surface 103 to which the luminaire is mounted. (The fixture is mounted by suitable brackets (not shown).) A substantial portion of this light will be reflected toward the luminaire and specifically to the lower lens element 97 which will transmit the light to induce brightness in the lens. It is contemplated that lens element 97 will have an interior prismatic surface for providing a generally light diffusing prismatic lens which can be seen by observers in the vicinity of the luminaire when the bottom of the luminaire is substantially at the observer's eye level or above eye level. As in the other embodiments of the invention, this lens element will provide the observer with a perception of seeing source brightness whereas otherwise the observer would normally only generally be aware of indirect light from walls and ceilings without the perception of seeing the source producing the indirect lighting.

Reference is now made to FIGS. 10–12 and the luminaire shown therein. Luminaire 105 has a primary light source in the form of biax lamps 107, an elongated opaque housing 109 having upwardly extending side walls 111, 113, and a ballast 115 placed in the bottom of the housing. Elongated, arcuate lens elements extend generally upward and inward from the top of the housing side walls so as to compliment the shape of the housing. A reflector 121 disposed beneath the light source has substantially vertical side walls 123, 125 disposed slightly inward of the lens elements 117, 119 and extending upward to near the top of the lenses. As discussed in connection with earlier embodiments of the invention, the reflector, including its vertical side walls, act to direct the primary source light generally upward and laterally of the luminaire through the luminaire's top opening 127 to illuminate an overhead ceiling surface below which the luminaire is suspended or otherwise mounted.

As best seen in FIG. 10, a second reflector element 129, 131 is inserted directly behind each of the elongated lens elements. It can be seen that the lens elements are, in this embodiment of the invention, positioned such that secondary light reflected back from an overhead ceiling surface will strike the exterior surface 133, 135 of the lenses, rather than the interior surface as in previously described versions of the invention. The reflector elements, 129, 131 behind the lens elements will act to reflect the secondary light passing through the lens elements back out through the lens as if the light were coming from within the luminaire housing itself. This secondary source of light will, in turn, induce in the lens elements a uniform brightness without shadows or hot spots.

Referring to FIG. 12, the lens of the FIGS. 10 and 11 embodiment of the invention is generally an elongated extruded acrylic prismatic lens having a prismatic surface 137 on the interior lens surface. As shown in FIG. 12 and the prism angle chart associated therewith, the prism angles for the prismatic surface 137 can be chosen so that the lens element acts as a light distribution control element for laterally spreading the light from the luminaire to achieve a more widespread overhead light distribution pattern.

It is noted that the lenses 133, 135 of the FIGS. 10–12 luminaire have a base end 139, on which there is formed a downwardly projecting mounting rib 141, and an upper end 143 having a groove 145 for receiving and holding the top edges of the reflector elements 129, 131. The upper end 143 of the lens is also preferably made to be opaque, such as by means of an opaque co-extrusion. The opacity in the end or tip of the lens will prevent any possible streaking at the top of the lens caused by direct light from the high intensity biax lamps 107.

It can therefore be seen that the present invention is a lensed system and luminaire for indirect lighting which provides uniform lens brightness over the visible exterior surface of the lenses and which eliminates distracting shadows or localized bright areas in the lenses. Although the present invention has been described in considerable detail in the foregoing specification, it is understood that the invention is not intended to be limited to such detail, except as necessitated by the following claims.

What we claim is:

1. A system for indirect lighting comprising a primary light source for indirect lighting, structural means for positioning said primary light source proximate a reflective surface whereby said reflective surface acts as a secondary source of light, at least one generally visible light transmissive element which modifies the direction of light incident thereon, said light transmissive element being positioned to receive reflected light from said secondary source of light, means for causing at least a portion of the secondary source light incident on said light transmissive element to be directed into normal viewing angles for persons observing said light transmissive element, and light foil means disposed between said primary light source and said light transmissive element for substantially blocking direct transmission of light to said light transmissive element from said primary light source whereby the observable brightness of said light transmissive element is induced substantially entirely by said secondary source of light.

2. The indirect lighting system of claim 1 wherein light transmissive element is a prismatic lens.

3. The indirect lighting system of claim 1 wherein said light transmissive element is a light diffuser element.

4. The indirect lighting system of claim 1 wherein said light transmissive element is positioned proximate said primary light source.

5. The indirect lighting system of claim 1 wherein said reflective surface is situated generally overhead said structural means and said light transmissive element is positioned generally below said reflective surface proximate said primary light source.

6. A luminaire for indirect lighting comprising a primary source of light, a housing having at least one opaque side wall and an opening to permit light from said primary source of light to be directed from said luminaire for illuminating a reflective surface proximate thereto whereby said reflective surface acts as a secondary source of light directed back toward said luminaire, at least one generally visible light transmissive element which modifies the direction of light incident thereon, said light transmissive element extending from said housing side wall to receive reflected light from said secondary source of light, means for causing at least a portion of the secondary source light incident on said light transmissive element to be directed into normal viewing angles for persons observing said light transmissive element, light foil means disposed between said primary light source and said light transmissive element for substantially blocking direct transmission of light to said light transmissive element from said primary light source whereby the observable brightness of said light transmissive element is induced substantially entirely by said secondary source of light.

7. The luminaire of claim 6 where said light foil means includes a reflector strip extending generally from said housing side wall in the direction of said housing opening and inwardly of said light transmissive element.

8. The luminaire of claim 6 wherein said light transmissive element has an interior surface and an exterior surface, the latter of which is visible at normal viewing angles, said light foil means is spaced inward of said light transmissive element, and said light transmissive element extends from said housing side wall so that reflected light from said secondary light source is incident upon the interior surface of said light transmissive element.

9. The luminaire of claim 6 wherein said light transmissive element has an interior surface and an exterior surface, the latter of which is visible at normal viewing angles, said light transmissive element extends from said housing side wall so that reflected light from said secondary light source is incident upon the exterior surface of said element, and said light foils means includes reflector means extending behind the interior surface of said light transmissive element so that at least a portion of the light passing through said element from said secondary light source is reflected back through said element into normal viewing angles for said luminaire.

10. A luminaire for indirect lighting comprising a primary source of light, a housing having at least one opaque side wall extending upward about said primary light source and a top opening to permit light from said primary light source to be directed from the luminaire for illuminating a generally overhead reflective surface whereby said reflective surface acts as a secondary source of generally downward directed light, at least one lens element secured along the opaque side wall of said housing, said lens element extending from said side wall so as to receive light from said secondary source of light and directing at least a portion of said received light into normal viewing angles for said luminaire, and a light foil means disposed between said primary source of light and said lens element so as to substantially block direct transmission of light to said lens element from said primary source of light whereby the brightness of said lens element is induced substantially entirely by said secondary source of light.

11. The indirect luminaire of claim 10 wherein said light foil means is comprised of at least one reflector element disposed generally behind said lens element to reflect light from said primary source of light generally upwardly through the top opening of said housing and away from said lens element.

* * * * *